US006829880B2

(12) United States Patent
Noferi

(10) Patent No.: US 6,829,880 B2
(45) Date of Patent: Dec. 14, 2004

(54) TIRE COMPRISING METAL CORD

(75) Inventor: Omero Noferi, San Giovanni Valdarno (IT)

(73) Assignee: Pirelli Pneumatici S.p.A., Milan (IT)

( * ) Notice: Subject to any disclaimer, the term of this patent is extended or adjusted under 35 U.S.C. 154(b) by 0 days.

(21) Appl. No.: 10/720,666

(22) Filed: Nov. 25, 2003

(65) Prior Publication Data

US 2004/0118498 A1 Jun. 24, 2004

Related U.S. Application Data

(62) Division of application No. 10/187,610, filed on Jul. 3, 2002, now Pat. No. 6,698,179, which is a division of application No. 09/886,379, filed on Jun. 22, 2001, now Pat. No. 6,446,423, which is a continuation of application No. PCT/EP99/10055, filed on Dec. 14, 1999.

(60) Provisional application No. 60/122,391, filed on Mar. 2, 1999.

(30) Foreign Application Priority Data

Dec. 24, 1998 (EP) ..... 98830785

(51) Int. Cl.[7] ..... D02G 3/48

(52) U.S. Cl. ..... 57/9; 57/236; 57/311; 152/451

(58) Field of Search ..... 57/1 R, 6, 9, 200, 57/236, 237, 311, 314, 351, 902; 152/451, 526, 539, 548

(56) References Cited

U.S. PATENT DOCUMENTS

| | | | | |
|---|---|---|---|---|
| 2,230,272 A | | 2/1941 | Slayter | |
| 2,729,030 A | | 1/1956 | Slayter | |
| 4,258,543 A | | 3/1981 | Canevari et al. | |
| 4,276,682 A | | 7/1981 | Rüber et al. | |
| 4,604,861 A | * | 8/1986 | Matsuura et al. | 57/9 |
| 4,891,493 A | * | 1/1990 | Sato et al. | 219/137 R |
| 5,020,312 A | | 6/1991 | Watakabe | |
| 5,213,652 A | | 5/1993 | Katoh et al. | |
| 5,287,691 A | * | 2/1994 | Okamoto et al. | 57/236 |
| 5,319,915 A | | 6/1994 | Kobayashi et al. | |
| 5,581,990 A | | 12/1996 | Van Giel et al. | |
| 5,584,169 A | | 12/1996 | Ikehara | |
| 5,722,226 A | | 3/1998 | Matsumaru | |
| 6,016,647 A | | 1/2000 | Kawatani et al. | |
| 6,446,423 B1 | | 9/2002 | Noferi | |

FOREIGN PATENT DOCUMENTS

| | | | | |
|---|---|---|---|---|
| EP | 0168857 | | 1/1986 | |
| EP | 0791682 | | 8/1997 | |
| FR | 1568875 | | 5/1969 | |
| JP | 64-040687 | | 2/1989 | |
| JP | 401040687 A | * | 2/1989 | D07B/1/06 |

* cited by examiner

*Primary Examiner*—John J. Calvert
*Assistant Examiner*—Shaun R Hurley
(74) *Attorney, Agent, or Firm*—Finnegan, Henderson, Farabow, Garrett & Dunner, L.L.P.

(57) ABSTRACT

A tire for a vehicle wheel, includes a torus-shaped carcass, a tread located on a periphery of the carcass, and a pair of axially-facing side walls ending with beads reinforced with bead wires and respective bead-filling elements for mounting the tire on a corresponding rim. The tire includes rubberized fabrics reinforced with metal reinforcing cords. At least one of the metal reinforcing cords comprises at least two wires helicoidally double-twisted around a longitudinal axis of the metal cord. Further, at least one of the wires is permanently deformed by a substantially-sinusoidal deformation lying in a plane.

14 Claims, 9 Drawing Sheets

TIRE COMPRISING METAL CORD

CROSS-REFERENCES TO RELATED APPLICATIONS

This application is a divisional of U.S. patent application Ser. No. 10/187,610, filed Jul. 3, 2002, now U.S. Pat. No. 6,698,179 in the U.S. Patent and Trademark Office, which is a divisional of U.S. patent application Ser. No. 09/886,379, filed Jun. 22, 2001, in the U.S. Patent and Trademark Office (now U.S. Pat. No. 6,446,423), which is a continuation of International Patent Application No. PCT/EP99/10055, filed Dec. 14, 1999, in the European Patent Office; also, Applicant claims the benefit under 35 U.S.C. § 119(e) based on prior-filed, provisional application No. 60/122,391, filed Mar. 2, 1999, in the U.S. Patent and Trademark Office; additionally, Applicant claims the right of priority under 35 U.S.C. § 119(a)–(d) based on patent application No. 98830785.6, filed Dec. 24, 1998, in the European Patent Office; the contents of all of which are relied upon and incorporated herein by reference.

BACKGROUND OF THE INVENTION

1. Field of the Invention

This invention relates to a device for preforming one or more elementary wires forming a metal reinforcing cord. This cord is especially suitable for reinforcing composite elastomeric matrix products, such as tyres.

In particular, the preforming device according to the present invention is suitable for operating on high carbon content metal wires, which are preferred for manufacturing high elongation cords.

2. Description of the Related Art

The expression "high elongation" is used to indicate the capacity of the reinforcing elements to be stretched under stress, at least initially, to a considerable extent, thanks to the employment of specific materials and/or certain specifically selected geometrical shapes so as to fulfil particular manufacturing phases of tyres and/or conditions of use of tyres.

In particular, these cords, defined as "HE" (High Elongation), present an ultimate elongation between 4% and 10%.

The wires led out of this preforming device according to the invention are subsequently fed to a traditional stranding station known from the art where the wires thus preformed are twisted around the longitudinal axis of the cord thus obtained.

A further object of the present invention is a procedure for manufacturing said cord, comprising the following phases: preforming one or more elementary wires forming said cord by subjecting them to a permanent deformation along their longitudinal development; stranding the elementary wires by means of a helicoidal twisting around the longitudinal axis of the cord.

Furthermore, the present invention relates to a metal cord, preferably a reinforcing cord, obtained by means of a preforming process and of a subsequent stranding of the aforesaid type.

The cord hereof is specifically designed to be used in manufacturing tyre components for motor vehicles but can be easily employed to manufacture other items, such as for example pipes for high pressure fluids, belts, belt conveyors or any other product made of elastomer-based composite material.

As is known, the metal cords usually employed to reinforce elastomeric products are generally made of several elementary wires helicoidally twisted around an axis which coincides with the longitudinal development of the cords themselves.

Preferably said cords are produced by means of stranding machines comprising: a supporting structure; a rotor coupled to said supporting structure which is rotatable according to a predefined axis; a cradle fastened to the supporting structure according to an oscillation axis which coincides with the axis of rotation of the rotor; feeding devices operatively assembled on said cradle and/or on its outside, suitable for feeding one or more elementary wires coming from respective feeding spools, said one or more elementary wires being driven along suitable stranding paths; and preferably at least one preforming device operating on one or more elementary wires in a section of the wires which precedes the subsequent stranding phase.

This preforming device imposes to said one or more elementary wires a permanent flexure deformation suitable for supporting and improving the subsequent arrangement of the wires according to a helicoidal development which ensures the necessary keeping of the structural compactness of the cord.

Furthermore, it is important to note that these cords, especially when employed in the manufacturing of tyres, are generally required to be provided with high mechanical resistance and to allow a good physico-chemical adhesion with the elastomeric material in which they are embedded, as well as an efficient penetration of said material in the space surrounding each wire of said cord.

In fact it is known that in order to eliminate the risk of the cords undergoing undesired corrosion phenomena once introduced in a tyre, or inside any product made of elastomeric material, it is very important that the elementary wires forming the cords are entirely coated, for their entire superficial extension, by the elastomeric material in which the cord is embedded.

This result, which is more difficult to be achieved when more complex cords are considered, is not easily achieved even when dealing with cords formed by a low number of elementary wires.

In fact, in order to confer the required geometric and structural stability to the cord, the elementary wires forming the cord are compacted, i.e. positioned intimately in contact with one another, leading to the formation of one or more closed cavities inside said cord which extend along the longitudinal development of the cord.

These cavities are closed and, consequently, cannot be reached by the elastomeric material during the normal rubberizing phases of the cord and, as a consequence, corrosion may develop inside said closed cavities and propagate along the elementary wires forming the cord.

As a consequence, this means, for example, that owing to cuts or punctures in the tyre structure, or to any other reason, humidity and/or external agents can penetrate into said closed cavities inevitably starting a rapid process of corrosion of the elementary wires, thus severely compromising the structural resistance of the cord and of the tyre.

Furthermore, the presence of said closed cavities which cannot be reached by the elastomeric material involves a reduced adhesion of the wires to the elastomer, which—above all if said cords are used for manufacturing tyres—in use can cause an undesired tendency of the wires to separate from the elastomer.

An additional disadvantage due to insufficient rubberizing of the wires, caused by the presence of said closed cavities, is the development of fretting of the wires in contact with one another. This generates an inevitable degeneration of resistance to fatigue of the wires and, consequently, of the cord.

An attempt to overcome this type of problem known in the art consists of using so-called "open" cords, where the wires (generally from three to five) are kept distant from one another during the entire rubberizing phase, carried out according to known procedures consisting of keeping a traction load not exceeding five kilograms applied to the cord.

Said cords are, for example, described in U.S. Pat. No. 4,258,543 in the name of the Applicant. These cords allow a greater penetration of the rubber between the wires forming the cords.

However, the cords thus obtained present several problems, especially in use, since the wires forming the cords tend to be distanced also when they are subjected to considerable traction stress during tyre manufacturing and in tyre use. This fact causes undesired geometric and structural instability of the cords which damages the performance of the tyre.

According to a further embodiment of the prior art, so-called double-diameter cords are used, i.e. cords with two pairs of wires where the diameter of the wires of the first pair is suitably differentiated from that of the second pair.

It is also known (see EP Patent 168,857) to make a metal cord having a first pair of elementary wires of equal diameter and a second pair of elementary wires with a diameter smaller than that of the first pair. Said first and second pairs are fed into a conventional internal collection stranding machine after crossing a circular preforming head where the wires of the first and second pair follow paths which ensure differentiated preforming actions with respect to each other.

The cord thus obtained, consequently, presents the pair of wires with a larger diameter helicoidally twisted together and in reciprocal contact, while each wire of the second pair is interposed between the two wires of the first pair and extends in parallel to the latter, being suitably distanced from them.

In this way, the aforesaid closed cavities are eliminated from the cross section of the cord, ensuring total coverage of elementary wires by the elastomeric material used during the rubberizing phase.

However, the suggested technical solution involves that the wires with the smallest diameter are distanced from those with the largest diameter also when the cord is subjected to traction stress in use. This fact, as for the aforesaid "open" cords, causes a certain geometric and structural instability of the cord which is not advantageous.

Furthermore, it is very difficult to confer to the cord thus obtained an accurate and regular geometrical configuration in each point of its longitudinal development since the constant reciprocal position of the wires in the cord is ensured by the particular type of used preforming device but the distance between the wires with the smallest diameter and the wires with the largest diameter tends to vary randomly in the various points of the longitudinal development, both in conditions of rest and of use of the cord.

According to a further preforming method for known in the art and described in the aforesaid U.S. Pat. No. 4,258,543 in the name of the Applicant, a roller preforming machine can be used. The roller is idle and presents several preforming seats, each located so as to operatively engage a respective elementary wire of the cord.

These preforming seats are circumferential grooves in the surface of the roller, the width of which is substantially equal to the diameter of the corresponding elementary wire, with a semicircular profile end portion having an axis coplanar to that of the end portions of the other circumferential grooves.

In this way, preforming can be varied by adjusting the radius of curvature of said grooves or by adjusting the tension applied to the wire. However, even this solution presents problems since the preforming action operated on the wire is often thwarted by the dynamic stranding pulls.

To solve the problem of poor rubberizing of the wires of a given cord—fact which can, as mentioned, cause consequent undesired corrosion problems—a suggested solution consists of cords generally formed with a low number of wires, where at least one of the elementary wires is deformed during preforming so as to acquire a pat tern which is no longer continuous but presents a suitable broken line.

Such embodiment is described, for example, in U.S. Pat. No. 5,020,312 according to which at least one wire of a given cord is subjected to a zigzag pattern along the longitudinal direction of said cord.

This renders a continuous contact between at least two adjacent wires along the longitudinal development of the cord impossible, thus causing the formation of detachment areas between said two wires, i.e. inlet openings allowing the introduction of rubberizing material at each zigzag bend of the wire.

According to the matter disclosed in this document, one or more wires suitable for forming a given cord are unwound from respective storage spools and fed to a pair of opposed cog wheels through which the above mentioned one or more wires are passed and preformed according to the axial direction conferring the aforesaid zigzag pattern.

This type of preforming is exhaustively described and illustrated in detail also in U.S. Pat. No. 5,581,990.

However, the greatest problem presented by the cords manufactured according to this operative method resides in a remarkable crushing of the external fibers of the wires forming a given cord at the bending apex. This fact involves an inevitable and undesired decrease in the fatigue resistance values of said cord and, consequently, a decrease in the qualitative level of the tyre in which said method is used.

Furthermore, it is known to use preforming devices provided with preforming heads for impressing an axial deformation to one or more of said wires. More in particular, U.S. Pat. No. 5,319,915 discloses the positioning of a flat surface, which extends in parallel to the axis of a wire, before stranding. Said flat surface is provided with preforming heads consisting of several pins positioned perpendicularly with respect to this flat surface at a regular distance from one another.

As illustrated in U.S. Pat. No. 5,722,226, said pins can be located on a supporting structure which may also be conical or cylindrical (i.e. not necessarily flat) and may be aligned or suitably staggered to provide the wire to be preformed with the desired zigzag path.

This device, consequently, is positioned so that said wire passes alternatively over and under said sequence of heads, while the entire device is rotated around its axis which is parallel to the axis of the wire.

SUMMARY OF THE INVENTION

The Applicant has surprisingly found a stranding system for manufacturing a metal cord provided with a good elastomeric material penetration between the wires forming said metal cord, as well as provided with a good fatigue resistance with respect to similar cords known in the art.

In particular, the Applicant has found that by applying a soft preforming action—substantially sinusoidal—to one or more metal wires forming a given cord, the cord presents a better fatigue resistance, for example, with respect to cords obtained by means of a preforming process employing cog wheels.

More in particular, the Applicant has surprisingly found that a cord according to the invention presents an increased ultimate elongation, while the penetration of the cord into the elastomeric material is considerably increased with respect to the abovementioned wires of the prior art.

A first aspect of the present invention relates to a device for manufacturing metal cords, to be used particularly for reinforcing composite elastomeric products. Said device comprises:

- a supporting structure;
- a rotor engaged with respect to the supporting structure and rotatable according to a predefined axis;
- a cradle fastened to the supporting structure according to an oscillation axis which coincides with the rotation axis of the rotor;
- feeding devices operatively fitted on said cradle to feed several elementary wires from respective feeding spools, said elementary wires being driven onto the rotor according to a stranding path with end sections coinciding with the rotation axis of said rotor and with a central section distanced from said rotation axis;
- at least one preforming device operatively engaged with the cradle and operating on one of said elementary wires in a section upstream with respect to the first end section of the stranding path, characterized in that said at least one preforming device is suitable for providing said elementary wire with a substantially sinusoidal deformation without sharp edges, i.e. developing according to a continuous curved line without points of discontinuity.

Preferably, the device according to the invention comprises one preforming device for each elementary wire of the cord.

More in particular, said at least one performing device of the device according to the invention comprises a first and a second pulley fastened to a suitable supporting structure and free to rotate about its axis, each pulley having various opposed pins suitable for reciprocally penetrating each other for a predefined distance so as to induce a sinusoidal deformation without sharp edges on a wire passing through the space between the pins of the first pulley and the corresponding pins of the second pulley.

A further aspect of the present invention relates to a process for manufacturing a metal cord, particularly suitable for reinforcing composite elastomeric products, said cord comprising at least two elementary wires, with a diameter preferably between 0.10 and 0.50 mm, said process comprising the following phases:

- permanently deforming at least one of said elementary wires by means of a deformation which is substantially sinusoidal without sharp edges;
- stranding said elementary wires together by means of helicoidal double twisting around the longitudinal axis of said cord.

A further aspect of the present invention relates to a metal cord, particularly suitable for reinforcing composite elastomeric products, comprising at least two elementary wires at least one of which is preformed according to the process of the invention.

A further aspect of the present invention relates to a tyre for vehicle wheels comprising a torus-shaped carcass, a tread located on the periphery of said carcass, a pair of axially facing side walls ending with beads reinforced with bead wires and respective bead filling elements for fixing said tyre to a corresponding mounting rim, said tyre also comprising rubberized fabrics reinforced with metal reinforcing cords, comprising at least two elementary wires which are helicoidally twisted together and around the axis of longitudinal extension of the cord, characterized in that at least one of said elementary wires is permanently deformed by means of a substantially sinusoidal deformation without sharp edges.

BRIEF DESCRIPTION OF THE DRAWINGS

Further features and advantages of the present invention will be better explained by the following detailed description of some preferred embodiments hereof, reproduced with reference to the accompanying drawings, where.

DETAILED DESCRIPTION OF THE PREFERRED EMBODIMENTS

Figure 1:
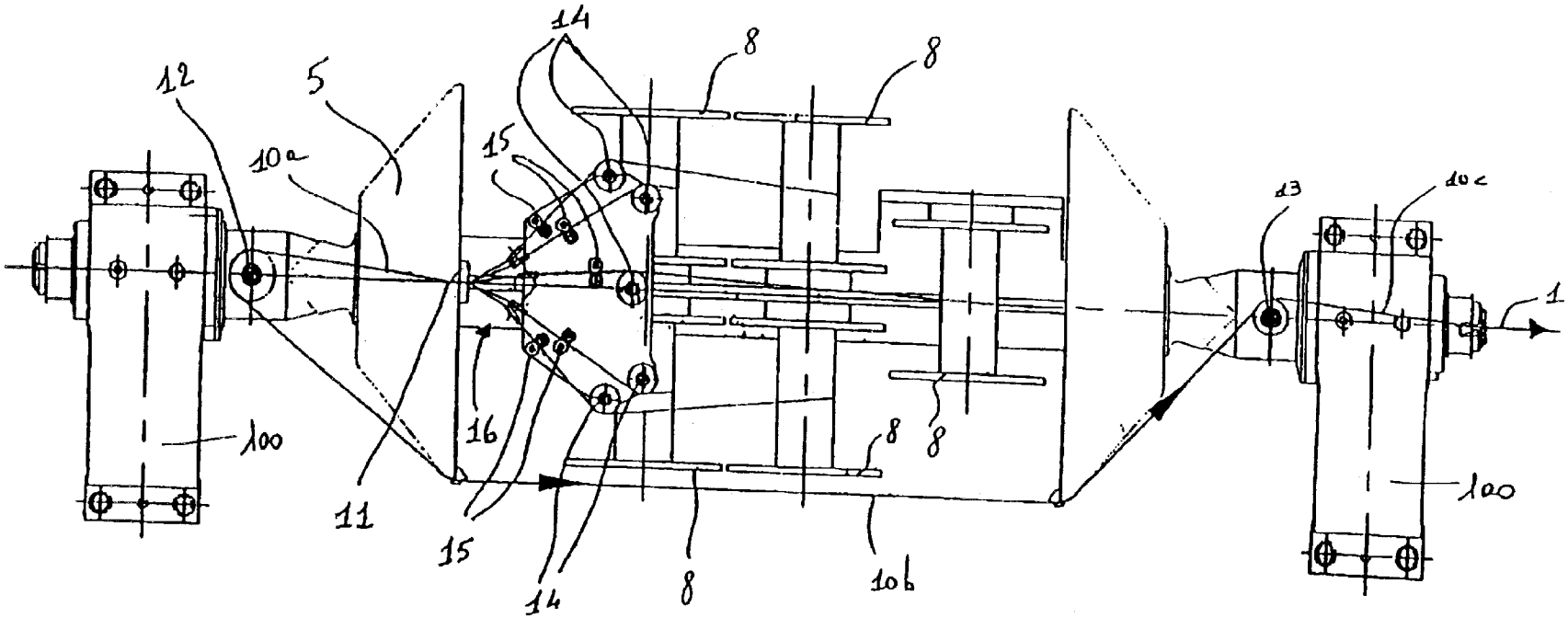
FIG. 1 illustrates, in a lateral view, a known stranding machine where the preforming device according to this invention is used.

With reference to the aforesaid Figures, reference sign 1 generally indicates a metal reinforcing cord to be used particularly in composite elastomeric products, specifically tyres for motor vehicles, according to the present invention.

In a manner known per se, cord 1 comprises several elementary wires, made of steel with a carbon content between 0.65% and 0.98% and with a diameter between 0.10 mm and 0.50 mm, helicoidally twisted around the axis of longitudinal extension of the cord.

However, steel, which is the preferred material thanks to its mechanical properties, presents the disadvantage of not sufficiently adhering to vulcanized elastomeric material. Consequently, to attain good adhesion to the elastomeric material, the steel is generally coated with a layer of suitable material. This coating material is preferably brass. Other coating materials, however, can be used, such as alloys containing Cu, Zn, Ni, Co, Mn. In the preferred case of brass coating, adhesion is favoured by the formation during vulcanisation of bisulphide bridges (—S—S—) between the elastomeric matrix and the copper which—being a component of brass—coats the metal reinforcing element.

The known procedures for coating a metal element with a layer of brass can be divided into two families: plating and diffusion. The first comprises electrolytic plating of copper and zinc while the second comprises electro-plating of one or more layers of copper on steel, followed by the electroplating of a layer of zinc and by a thermal treatment with the purpose of diffusing the zinc in the copper layers, thus forming a layer of brass.

These wires are then, preferably, brass-coated with a metal composition consisting of from 30% to 40% by weight in zinc and from 70% to 60% by weight in copper, more preferably 32.5% weight in zinc and 67.5% weight in copper, to form a layer of brass equal to approximately 0.25 $\mu$m±0.05.

The specific features and constructive features of cord 1 according to the invention will be better understood by means of the following description, both as regards the device used and the procedure for its manufacturing.

FIG. 1 illustrates an example of stranding machine, in particular suitable for forming a cord consisting of 5 elementary wires.

The machine for the production of metal reinforcing cord 1 comprises, in a known configuration, a supporting structure 100 to which a rotor 5 is rotatively engaged, the latter being rotated by means of a motor or similar devices (not illustrated). Furthermore, a cradle (not illustrated in the Figure) is connected to said supporting structure and can rock about the rotation axis of rotor 5. Several feeding spools 8 are operatively engaged on the cradle. At least one elementary wire of said cord 1 is wound on each of the spools.

Furthermore, suitable unwinding devices (not illustrated because known per se and conventional) are coupled to spools 8, which are fitted on the cradle to suitably guide the elementary wires coming from spools 8.

In a known way, the elementary wires at the outlet from the cradle are driven onto rotor 5 according to a predefined stranding path along which cord 1 is formed through the effect of rotation imposed on rotor 5 by means of said motor or equivalent device, in combination with the drive produced on the cord by means of collection devices (not illustrated since known and not relevant to the scope of the invention).

More in particular, the stranding path comprises a first end section 10*a* essentially coinciding with the rotation axis of rotor 5 and delimited by a first rotating transmission device 12, solidly fastened to rotor 5, and an assembly unit 11 consisting, in a known way, of a plate with five holes, solidly fastened to the cradle and, consequently, stationary.

Along this first end section 10*a* the wires are subjected to a first helicoidal torsion around the rotation axis of rotor 5 through the effect of the rotating pull which the rotor imposes on the first rotating transmission device 12.

Downstream of first rotating roller 12, the wires follow a central section 10*b* of the stranding path which extends to rotor 5 and is radially displaced with respect to the rotation axis of the rotor so as to skip cradle 7 and reach a second transmission device 13 solidly coupled to the rotor on the axially opposite end.

Finally, the stranding path presents a second end section 10*c* substantially coinciding with the rotation axis of rotor 5 and extending beyond second rotating transmission device 13. In this second end section, through the effect of the rotating pull imposed by rotor 5 on second rotating transmission device 13, a second torsion of the elementary wires is performed, thus completing the formation of cord 1 which is progressively pulled away by the aforesaid collection devices.

The ratio between the speed of rotation of rotor 5, preferably between 2000 and 6000 rpm, and the pulling speed of cord 13 and, consequently, of the elementary wires which form it, preferably between 60 and 250 m/min—defines the value of the stranding pitch, i.e. the pitch according to which said elementary wires are helicoidally twisted on finished cord 1.

In a preferred embodiment of the invention, said stranding pitch is kept at a value between 3 mm and 50 mm, preferably between 6 mm and 30 mm, more preferably equal to 16 mm.

The following elements are operatively arranged in sequence for each elementary wire along the path of the elementary wires inside the cradle, and more precisely upstream with respect to assembly unit 11: a rotating transmission device 14, a preforming device 15 according to the invention (shown in detail in FIG. 2) and a rotating transmission device 16 consisting of a pulley turned at 90° with respect to the pair of pulleys of the invention; said turned pulley has the purpose of conveying the wire coming out of preforming device 15, to assembly unit 11.

Figure 2A:
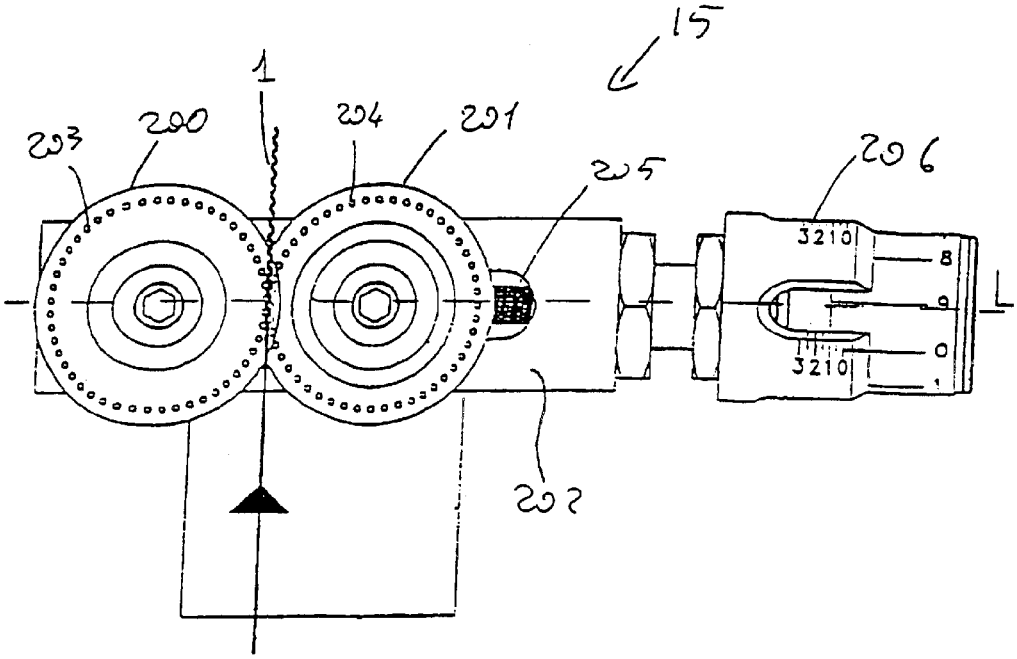
FIGS. 2*a* and 2*b* illustrate in detail a preforming device according to the present invention, in a plan top view and a partial side view, respectively.

With reference to FIG. 2*a*, preforming device 15 according to the present invention comprises a pair of pulleys 200 and 201, preferably a pair of steel plates, fastened to a suitable supporting structure 202 and free to rotate about their axes. Each pulley presents various opposed pins 203 and 204 suitable for reciprocally penetrating for a predefined extension so as to cause an axial deformation and a flexion deformation at the same time on a wire crossing the space between the pins of first pulley 200 and the corresponding pins of second pulley 201, during the aforesaid penetration obtained by the movement of the aforesaid pair of pulleys driven and rotated by the wire.

More in particular, the longitudinal axis of the aforesaid supporting structure is advantageously located perpendicularly to the direction of advancement of the wire to be subjected to the desired preforming operation.

Aforesaid pulleys 200 and 201 are fastened to said supporting structure 202 and opposed so that first pulley 200 is kept in a fixed position with respect to said supporting structure 202 but is free to rotate about its axis perpendicularly to longitudinal axis L of the supporting structure.

Second pulley 201 of this pair, on the contrary, is advantageously mobile along a straight guide 205 on the supporting structure and located in parallel to longitudinal axis L of the supporting structure so as to allow fine tuning of second pulley 201, by means of a suitable graduated scale 206, with respect to the first and thus to approach or distance the aforesaid pair.

Furthermore, as mentioned above, each pulley .200 and 201 of the preforming device according to the present invention is provided with a plurality of pins 203 and 204 of suitable length, located perpendicularly to the plate surface of the pulley and positioned consecutively one from the other so as to follow the peripheral profile of the pulley according to a predetermined pitch defined by the distance between the axes of two consecutive pins.

Figure 2B:
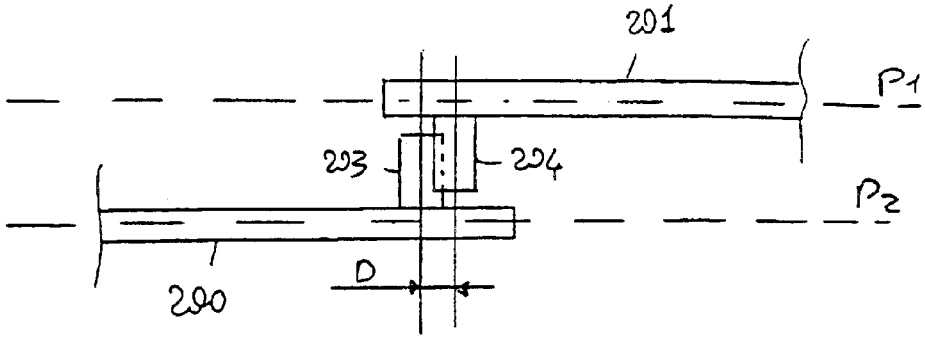

With reference to FIG. 2*b*, which illustrates a partial side view of preforming device 15 according to the invention, in order to allow reciprocal penetration of the pins possessed by said pair of pulleys, it is necessary that they are differently distanced from longitudinal axis L of the supporting structure, i.e. the plate surfaces of said pulleys belong to two different planes P1 and P2 parallel to one another and parallel to the plane containing longitudinal axis L of supporting structure 202.

Furthermore, to ensure the aforesaid penetration, pins 203 and 204 provided on first pulley 200 and second pulley 201 have to be located on opposed plate surfaces so that, during the rotation of said pulleys, the respective pins are in reciprocally opposite positions.

More in particular, the penetration of the pins of the pair of pulleys is variable and adjusted by moving second mobile pulley 201 closer or farther by means of aforesaid straight guide 205. This adjustment is performed by means of a graduated scale 206 which is calibrated so as to define the level of penetration of the pins and consequently the degree of preforming resulting on the wire downstream with respect to the preforming device according to the present invention.

The level of penetration of the pins represents, consequently, the shift—longitudinal with respect to supporting structure 202—made by second mobile pulley 201 in the direction of first pulley 200, which is fixed.

In particular, said level of penetration represents the distance D between the axis of a first pin 203 possessed by fixed pulley 200 and the axis of a second pin 204 on mobile pulley 201. Said second pin 204 is in consecutive position with respect to the first so that aforesaid distance D is measured in the penetration area of said first and second pin. Said area defines the preforming path of said wire.

Finally, the stranding machine comprises a stretching device (capstan), a device for collecting the produced cord and the usual wire straightening devices, such as the false twister, to eliminate residual tension in the finished cord. These devices are not illustrated since known, conventional and not particularly relevant for the purposes of the invention.

According to a further embodiment of the invention, the stranding operation is such as to ensure that at least one wire of a given cord is subjected to preforming according to the present invention while the remaining wires of said cord are treated as described in the prior art. For example, said remaining wires can be subjected to preforming using a roller preforming machine, such as that described in aforesaid U.S. Pat. No. 4,258,543 in the name of the Applicant.

Preforming devices 15 according to the present invention are applicable to all types of known stranding systems, for example a double twist system or an arrangement system. More in particular, a double twist system can present internal collection (if the collection spool of the finished product is inside of the cradle, between the rotors) or external collection (if the feeding spools are inside of the cradle while the collection spool of the finished product is outside the cradle). The arrangement system, finally, differentiates from the double twist system as in arrangement machines each rotor turn corresponds to a single stranding pitch while in double twist machines each turn of the rotors corresponds to an advancement equal to two stranding pitches. Consequently, the difference between these two systems lies in their productivity.

According to a preferred embodiment of the invention, the pulleys used in the preforming device are overall identical, i.e. they have equal diameter, an equal number of pins and the pins used on both pulleys have the same diameter.

With preforming machine 15—thanks to its structure—it is possible to obtain a wire with a substantially sinusoidal wavy deformation on a plane that is parallel and intermediate to planes P1 and P2 containing the plate surfaces of the pulleys. Said wire does not present sharp edges, spikes or cuts on its surface. The elementary wire passing through the pins of the two pulleys is subjected to an alternating deformation defined by the circular shape of the pins, and does not present, as a consequence, sections with the aforesaid edges, spikes or cuts which are found, for example, on the external surface of the wires which pass through a pair of cog wheels according to the prior art. In fact, said cog wheels, due to the their geometric conformation, inevitably cut the surface of the wire during the take-up action which occurs during the preforming advancement of the wire. As mentioned above, this take-up action causes stresses of the wire.

Table I illustrates the main technical-constructive parameters of one embodiment of preforming device 15 according to the present invention. According to this embodiment, the pulleys of the device according to the invention present equal diameter, an equal number of pins and pins of equal diameter. However, other embodiments are possible, e.g. pulleys presenting pins with different diameters.

TABLE I

| Pin diameter (mm) | Number of pins | Pin pitch (mm) | Maximum pin penetration level (mm) wire Φ 0.12 | Maximum pin penetration level (mm) wire Φ 0.25 | Maximum pin penetration level (mm) wire Φ 0.35 | Maximum pin penetration level (mm) wire Φ 0.38 |
|---|---|---|---|---|---|---|
| 1 | 48 | 2 | 0.480 | 0.430 | 0.357 | 0.325 |
| 1.5 | 32 | 3 | 0.740 | 0.710 | 0.663 | 0.640 |
| 2 | 24 | 5 | 0.990 | 0.968 | 0.936 | 0.925 |
| 3 | 16 | 7.6 | 1.495 | 1.479 | 1.458 | 1.450 |
| 4 | 12 | 9.8 | 1.996 | 1.984 | 1.969 | 1.963 |
| 5 | 12 | 11.13 | 2.497 | 2.487 | 2.475 | 2.470 |

The most suitable selection of values to be attributed to the machine parameters is to be defined specifically according to, for example, the desired degree of preforming of the wire, the diameter of the wire (between 0.10 and 0.50 mm) and the desired value of the final features of the cord. Furthermore, it is important to underline that the pull exerted on the cord also depends on precise process parameter choices according to the features of the machines used, e.g. torsion angles, speed of rotors, stranding pitch.

It is also important to note that, to produce a cord, and consequently a rubberized fabric containing said cord, having high elasticity features, it is preferable to subject all the wires forming said cord to the preforming process according to the invention.

However, if the main requirement resides in the rubber penetration inside the cord, it may suffice to preform a limited number of the wires forming the cord. This number can be defined on the basis of the total number of wires forming the cord and the desired penetration degree.

Figure 3:
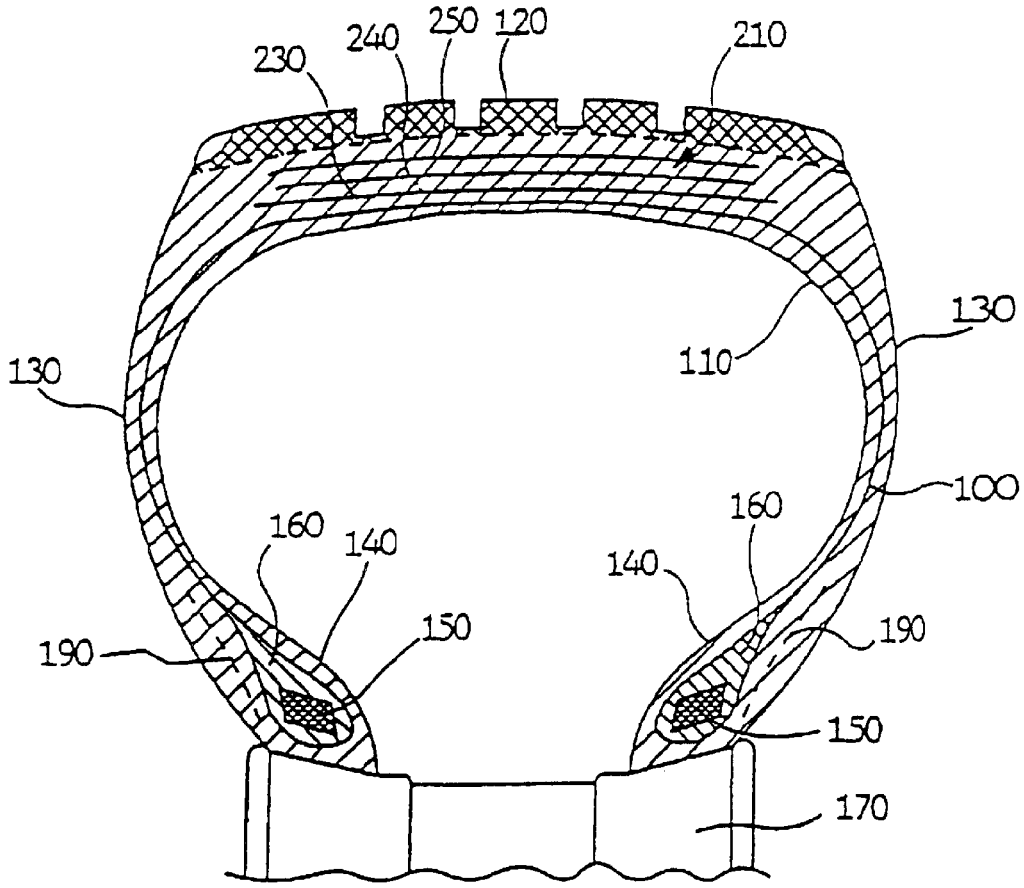
FIG. 3 illustrates a tyre, in partial straight section, provided with constituent elements comprising reinforcing cords according to the invention.
Figure 4A:
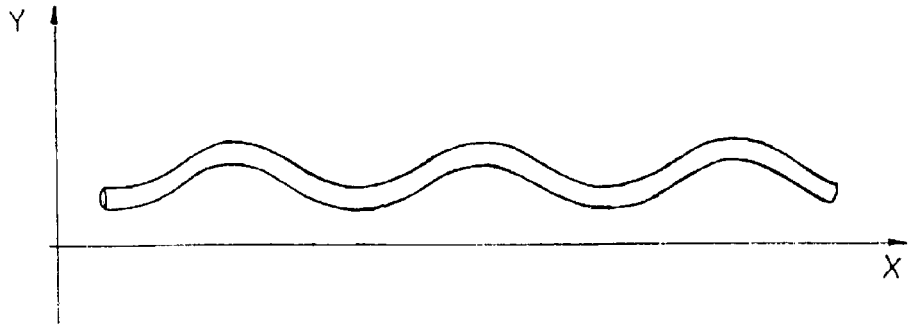
FIG. 4*a* shows a side view of a sinusoidally-deformed wire according to the invention.
Figure 4B:
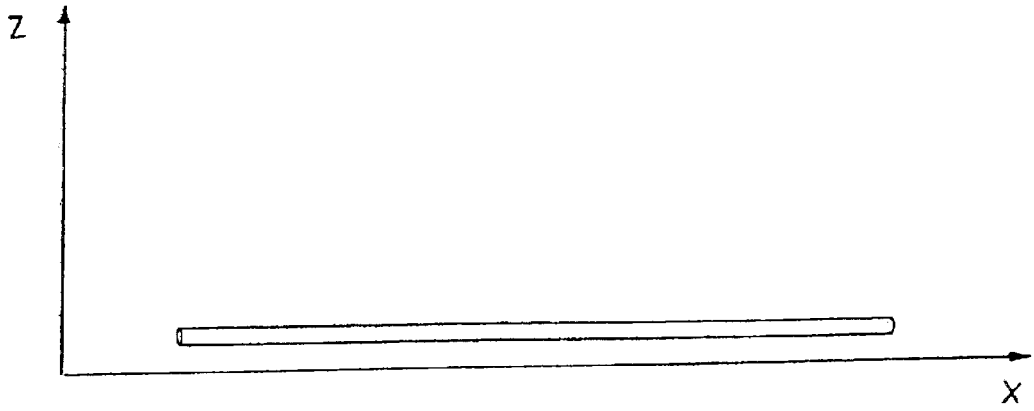
FIG. 4*b* shows a top view of the wire of FIG. 4*a;*
Figure 4C:
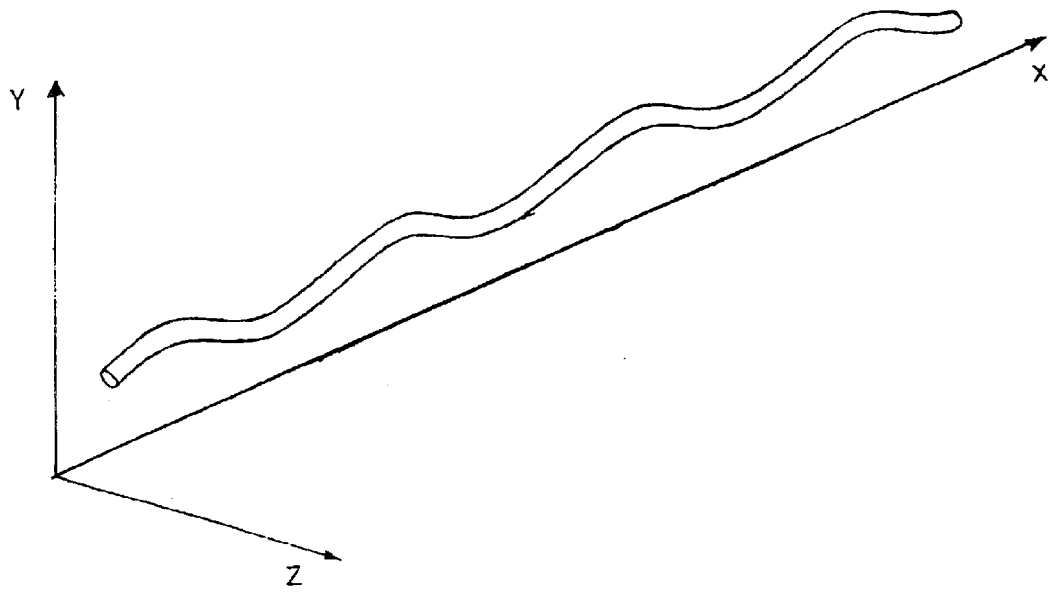
FIG. 4*c* shows a perspective view of the wire of FIG. 4*a;*
Figure 5A:
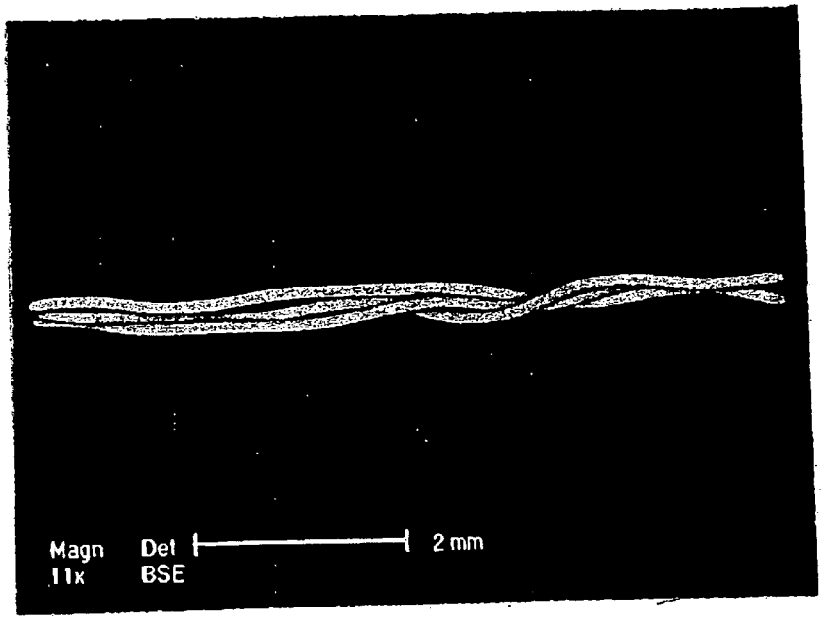
FIG. 5*a* shows a photographic top view of a cord of the present invention, comprising three sinusoidally-deformed wires.
Figure 5B:
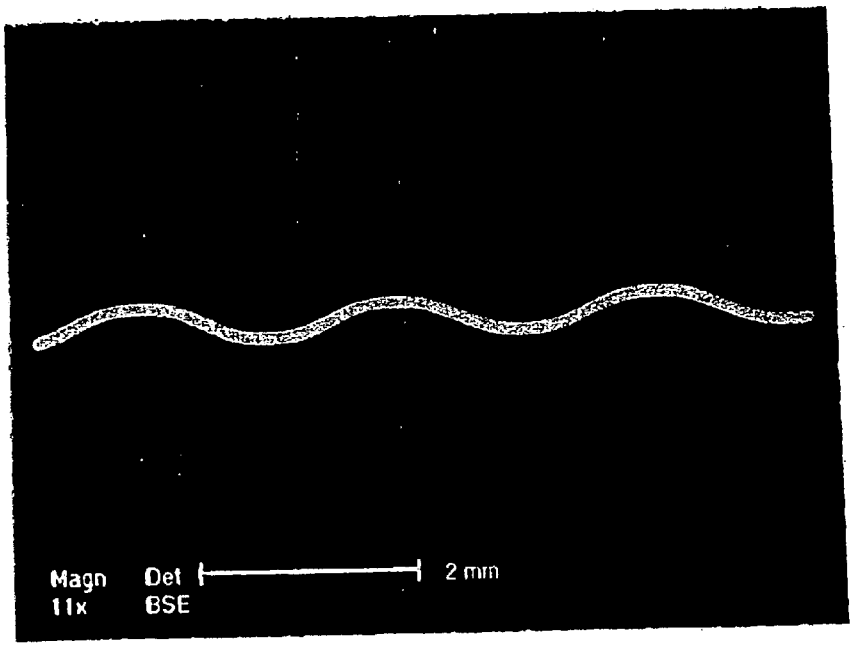
FIG. 5*b* shows a photographic side view of a sinusoidally-deformed wire according to the invention.
Figure 6:
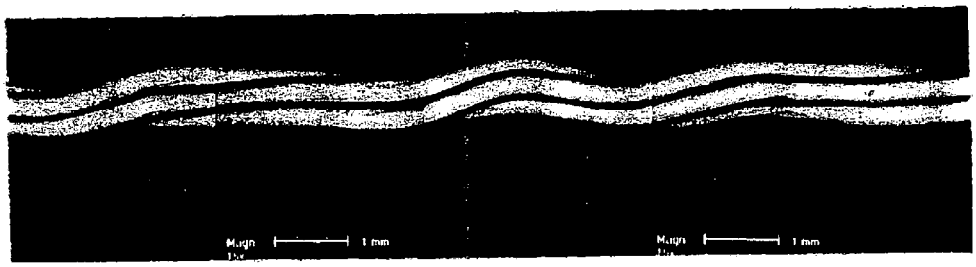
FIG. 6 shows a photographic top view of a cord of the present invention, comprising five

FIG. 3 illustrates a generic tyre comprising rubberized fabrics provided with reinforcing cords according to the invention. With reference to this Figure, the tyre to which the invention refers comprises a carcass 100, preferably internally covered with an air-tight sheet of rubber 110, a tread 120 located on the periphery of this carcass, a pair of axially facing side walls 130 ending with beads 140 reinforced with bead wires 150 and respective bead filling elements 160 in order to fix said tyre to a corresponding mounting rim 170. The tyre can additionally include reinforcing edges 190 and, in the case of radial carcass tyres, also a belt structure 210 interposed between carcass and tread.

Carcass 100 comprises one or more carcass plies fixed to said bead wires 150, for example, folded around said bead wires from the inside towards the outside. The carcass ply or plies can be formed by sections of rubberized fabric reinforced with textile or metal cords embedded in the fabric rubber.

Belt structure 210 comprises two belt strips 230 and 240, radially overlapping, and a third belt strip 250 in a radially outermost position.

Belt strips 230 and 240 are formed by sections of rubberized fabric incorporating metal cords, parallel with respect to each other in each strip and crossed with those of the adjacent strips, inclined preferably in a symmetrical manner with respect to the equatorial plane of the tyre at an angle of between 10° and 30°, while belt strip 250 is provided with cords which are circumferentially oriented, i.e. at 0° with respect to said equatorial plane. This strip 250 can be made, in particular for truck tyres and the like, by a pair of bands symmetrically located with respect to the equatorial plane of the tyre. For truck tyres, an auxiliary strip (not shown in the figure) may be used in external radial position with respect to belt structure 210, provided with reinforcing cords inclined with respect to the equatorial plane by an angle of between 10° and 70°, usually called "breaker layer".

Similarly, other constructive elements of the tyre can be formed by sections of rubberized fabric with suitably reinforcing cords inclined with respect to the axial, radial and/or circumferential directions of the tyre, as required. For example, aforesaid reinforcing edge 190 employs inclined cords according to an angle included between 30° and 60° with respect to the axial direction.

A sample of cord (5×0.35, pitch 16 mm, i.e. a cord formed by the concatenation of five wires with a diameter equal to 0.35 mm) was made according to the procedure of the invention. The wires forming said cord were made of steel with a carbon content equal to 0.7%. Furthermore, said wires were advantageously brass-coated, with a deposit coating equal to 3.74 g of brass in relation to 1 kg of steel, the percentage of copper in the brass is preferably equal to 64.4%. Preforming device 15 according to the invention used to obtain said cord sample presented pins with a diameter of 1.5 mm to attain a wire with a wavy (sinusoidal) shape of width equal to 0.75 mm and pitch equal to 3.25 mm.

Table II hereinbelow illustrates the results achieved by the Applicant in comparative tests between a 5×0.35 cord subjected to preforming according to the known method of the cog wheels and the same cord preformed according to the method of the invention as described above in detail. The values shown in Table II are the average values obtained by performing an arithmetical average among a plurality of values resulting from the tests performed by the Applicant.

TABLE II

| Main parameters | Cord according to the cog wheels method | Cord according to the invention |
|---|---|---|
| Cord diameter (mm) | 1.22 | 1.11 |
| Cord weight (KTex) | 3.93 | 3.88 |
| Ultimate tensile strength (bare cord) (N) | 1070 | 1089 |
| Ultimate elongation (bare cord) (%) | 4.77 | 5.92 |
| Ultimate tensile strenght (rubberized/vulcanised cord) (N) | 1060 | 1125 |
| Ultimate elongation (rubberized/vulcanised cord) (%) | 4.36 | 6.30 |
| Flexion fatigue (Kcycles) | 5405 | 7970 |
| Fabric penetration (crude) ($mm^3$/cm of cord) | 0.56 | 1.07 |
| Fabric penetration (vulcanised) ($mm^3$/cm of cord) | 0.03 | 0.05 |

The ultimate tensile strength and ultimate elongation tests were carried out both on bare cord and on cord embedded in the elastomer matrix and subjected to vulcanisation according to methods not described herein since typically known in the prior art.

The flexion fatigue test, known as FFF (Firestone Flexion Fatigue) test or Wallace test, was carried out on a strip of rubberized fabric. Said strip underwent a series of flexion cycles made by alternatively moving the strip of fabric around a suitably dimensioned roller with an adequately selected pre-load related to the dimensions of the reinforcing cords in the fabric sample.

The aforesaid test was conducted on a strip of rubberized fabric reinforced with metal cords arranged having a thickness equal to 100 cords/decimetre by applying to the roller a pre-load of 150 pounds (68 kg) by means of a lever mechanism and by using a roller with a diameter equal to 50 mm. This lever mechanism caused on the roller, and consequently on the sample, a force opposite and equal to said weight. The sample was positioned and the test consisted in counting the traction cycles made by the aforesaid alternating movement. The test ended when the sample broke.

The test related to the penetration in the fabric consisted in measuring the penetration degree of the rubber between the wires forming said cord and in identifying, as a consequence, the quality of the elastomer coating around each of said wires. A suitable funnel advantageously made of glass was reversed on the bottom of a bowl containing ethyl alcohol. This funnel presented a scale along the cylindrical stem and ended, on the free end of this stem, with a suction device generally worked by the operator. The operation of the suction device caused the ethyl alcohol to rise in the cylindrical stem to reach a predefined level, called zero level. In this phase, the sample to be examined, consisting of a strip of the type described above with dimensions. equal to 5 cm×5 cm, was submerged in the bowl and positioned at the inlet of the funnel. Ethyl alcohol has the property of expelling the air which may be contained in the elastomer matrix and to take its place. This fact caused a decrease with respect to the aforesaid zero level of the level of ethyl alcohol in the scaled stem. This measurement allowed to define the volume of air possessed by the elastomeric material in which the wires are embedded and, consequently, the penetration degree of the rubber between the wires forming the cord. This test was carried out both on the crude sample and on the vulcanised sample.

By analysing the figures reported in Table II, it appears evident that a given cord obtained according to the procedure of the invention presents physico-chemical features remarkably better with respect to an equal cord obtained according to a stranding process comprising a preforming device with cog wheels.

In the case of the invention, the ultimate elongation of the cord is considerably higher, as well as the flexion fatigue, which is considerably increased. This results in a card with improved mechanical features with respect to the prior art.

Furthermore, the achieved results confirm the obtainment of a greater rubber penetration and a considerably higher ultimate elongation which results in a greater elasticity of the cord. This aspect is particularly desired when these cords are used as reinforcing cords for elastomers used to manufacture tyres.

From the results achieved by the Applicant it arises that: a greater pin penetration degree, and consequently a greater preforming degree of the wires forming a cord, corresponds to a greater elongation reached by the cord.

The Applicant carried out the texts especially on a 1×5×0.35 cord obtained by a stranding process according to the invention. Said cord appeared particularly suitable for being used to form, for example, the so called breaker layer in the belts for heavy-load tyres and the like, advantageously used on "off-road" paths.

It is important to note that the cords obtained according to the invention can be used as reinforcing cords for any type of elastomeric structure to be used for manufacturing tyres, with particular preference for the elastomers requiring a high elongation cord, for example in reinforcing edges 190 shown in FIG. 3.

The Applicant has, in fact, observed that the ultimate elongation of a 1×5×0.35 cord is clearly better with respect to the ultimate elongation of a 3×4×0.22 cord, widely used in practice. Said cord consists of three strands, each of which formed by four 0.22 diameter wires.

More in particular, the ultimate elongation of a 3×4×0.22 bare-cord is equal to 5.5% and this value drops to approximately 3% after vulcanisation. In the case of the invention, on the other hand, the 5×0.35 cord presents an ultimate elongation of approximately 6% also after vulcanisation. This fact, as mentioned above, allows an advantageous use in breaker layers for heavy-load tyres which must absorb accidental knocks which can occur on "OFF" type roads.

Furthermore, this aspect appears particularly advantageous also in terms of costs, production time and process productivity according to the invention, since necessarily two working cycles with very limited stranding pitches (in particular equal to 3.15 mm for each strand and equal to 6.3 for the final cord) are required for making a 3×4×0.22 cord, while the cord according to the invention is obtained in a single working cycle and presents a higher stranding pitch (in particular equal to 16 mm).

Furthermore, making a 5×0.35 cord instead of a 3×4×0.22 cord allows to perform a milder drawing process with consequent savings in terms of working times and wear of the machines used.

What is claimed is:

1. A tyre for a vehicle wheel, comprising:

a torus-shaped carcass;

a tread located on a periphery of the carcass; and a pair of axially-facing side walls ending with beads reinforced with bead wires and respective bead-filling elements for mounting the tyre on a corresponding rim;

wherein the tyre comprises rubberized fabrics reinforced with metal reinforcing cords, wherein at least one of the metal reinforcing cords comprises at least two wires helicoidally double-twisted around a longitudinal axis of the metal cord, and wherein at least one of the wires is permanently deformed by a substantially-sinusoidal deformation lying in a plane.

2. The tyre of claim 1, wherein the wires each comprise a diameter greater than or equal to about 0.10 mm and less than or equal to about 0.50 mm.

3. The tyre of claim 1, wherein the wires each comprise a diameter greater than or equal to 0.10 mm and less than or equal to 0.50 mm.

4. The tyre of claim 1, wherein each of the wires is permanently deformed.

5. The tyre of claim 1, wherein the helicoidally double-twisted wires comprise a stranding pitch greater than or equal to 3 mm and less than or equal to 50 mm.

6. The tyre of ciaim 1, wherein the helicoidally double-twisted wires comprise a stranding pitch greater than or equal to 6 mm and less than or equal to 30 mm.

7. The tyre of claim 1, wherein the helicoidally double-twisted wires comprise a stranding pitch equal to about 16 mm.

8. A tyre for a vehicle wheel, comprising:

a torus-shaped carcass;

a tread located on a periphery of the carcass; and a pair of axially-facing side walls ending with beads reinforced with bead wires and respective bead-filling elements for mounting the tyre on a corresponding rim;

wherein the tyre comprises rubberized fabrics reinforced with metal reinforcing cords, wherein at least one of the metal reinforcing cords comprises at least two wires, wherein at least one of the wires is permanently deformed by a substantially-sinusoidal deformation lying in a plane, and wherein the wires are helicoidally double-twisted together around a longitudinal axis of the metal cord.

9. The tyre of claim 8, wherein the wires each comprise a diameter greater than or equal to about 0.10 mm and less than or equal to about 0.50 mm.

10. The tyre of claim 8, wherein the wires each comprise a diameter greater than or equal to 0.10 mm and less than or equal to 0.50 mm.

11. The tyre of claim 8, wherein each of the wires is permanently deformed.

12. The tyre of claim 8, wherein the helicoidally double-twisted wires comprise a stranding pitch greater than or equal to 3 mm and less than or equal to 50 mm.

13. The tyre of claim 8, wherein the helicoidally double-twisted wires comprise a stranding pitch greater than or equal to 6 mm and less than or equal to 30 mm.

14. The tyre of claim 8, wherein the helicoidally double-twisted wires comprise a stranding pitch equal to about 16 mm.

* * * * *